US006332747B1

(12) United States Patent
Lee

(10) Patent No.: US 6,332,747 B1
(45) Date of Patent: Dec. 25, 2001

(54) COUPLING APPARATUS FOR DETACHABLY ATTACHING AN EXCAVATING DEVICE TO EXCAVATOR

(75) Inventor: Won-Hae Lee, Seoul (KR)

(73) Assignee: Daemo Engineering Co., Ltd., Seoul (KR)

( * ) Notice: Subject to any disclaimer, the term of this patent is extended or adjusted under 35 U.S.C. 154(b) by 0 days.

(21) Appl. No.: 09/396,457

(22) Filed: Sep. 15, 1999

(30) Foreign Application Priority Data

May 11, 1999 (KR) ..... 99-7910

(51) Int. Cl.[7] ..... E02F 3/36
(52) U.S. Cl. ..... 414/723; 37/468
(58) Field of Search ..... 414/680, 685, 414/723; 37/468; 92/65

(56) References Cited

U.S. PATENT DOCUMENTS 3,978,884 * 9/1976 Sundstrom ..... 92/65 X
4,955,779 * 9/1990 Knackstedt ..... 414/723
4,984,850 1/1991 Jensen .
5,010,962 * 4/1991 Bloom, Jr. ..... 414/723 X
5,125,788 6/1992 Stenger .
5,332,353 7/1994 Arnold .
5,350,250 9/1994 Nagler .
5,431,528 7/1995 Jenkins et al. .
5,465,513 11/1995 Sonerud .
5,546,683 8/1996 Clark .
5,584,644 12/1996 Droegemueller .
5,592,762 1/1997 Hendron et al. .
5,791,863 8/1998 Droegemueller .
5,802,747 9/1998 Nojima .
5,802,753 * 9/1998 Raunisto ..... 414/723 X
5,813,822 9/1998 Pisco .
5,890,871 4/1999 Woerman .

* cited by examiner

*Primary Examiner*—Donald W. Underwood
(74) *Attorney, Agent, or Firm*—Robert E. Bushnell, Esq.

(57) ABSTRACT

A coupling device for automatically coupling an excavating device or a hammer device to an excavator includes an arm coupler fixed to one end of an arm of the excavator and a link coupler fixed to an operation link of the arm of the excavator. The excavating device includes a pair of brackets having a pair of the assembling holes. Piston rods, contained in the arm coupler and the link coupler and inserted into the assembling holes, connect the brackets of the excavating device to the excavator.

31 Claims, 7 Drawing Sheets

COUPLING APPARATUS FOR DETACHABLY ATTACHING AN EXCAVATING DEVICE TO EXCAVATOR

CLAIM OF PRIORITY

This application makes reference to, incorporates the same herein, and claims all benefits accruing under 35 U.S.C. §119 from an application for A COUPLER FOR EXCAVATION earlier filed in the Korean Industrial Property Office on May, 11, 1999 and there duly assigned Serial No. 7910/1999.

BACKGROUND OF THE INVENTION

1. Field of the Invention

The present invention relates to an apparatus for detachably attaching an excavating device to an excavator, and more particularly, to an apparatus for automatically attaching an excavating device to an excavator.

2. Description of the Related Art

Various types of excavating devices and percussion devices have been used in an excavator. Typically, an excavating device which is detachably attached to the excavator can be replaced by another excavating device or a percussion device, such as bucket, breaker, crusher, or a pneumatic or hydraulic jack hammer. The excavator, which is used for excavating or digging, may be used for breaking and crushing rocks or pavement if the excavating device is replaced by a percussion device. All of these devices must be detachably attached to the excavator.

In order to detach the attached device from the excavator and attach another device to the excavator, a user has to change the devices manually. It is very dangerous for the user to manually detach one device from the excavator and manually attach a new device to the excavator because it is difficult for the user to move and level the heavy devices. Moreover, the user may be injured while changing these devices and inserting a connecting pin into an assembling hole connected to a main arm of the excavator. Furthermore, the mechanism for an automatic coupling assembler for connecting the excavating device to excavator is not adequate to support the excavating device during the operation of the excavator because of the vibration and impact generated by the device. In order to reduce this problem, various types of the coupling assemblers have been used in efforts to protect the user and provides an automatic coupling mechanism. I have found, however, that with conventional apparatus and methods, the coupling assemblers can not support the devices during the operation of the excavator and cannot provide an automatic coupling mechanism with more efficiency and effectiveness, and that it is impossible to correct or otherwise improve the conventional apparatus and methods in order to get a more perfect apparatus and method for providing a more efficient and effective automatic coupling mechanism to support the device during the operation of the excavator.

U.S. Pat. No. 5,890,871 for a Latching Mechanism For A Quick Coupler issued to Woerman discloses a latch mechanism for a quick coupler for detachably coupling a bucket to the arm of a hydraulic excavator. A bracket includes a pair of elongated hook openings and a pair of latching notches. The quick coupler is pivotally connected to the arm by a pin and is pivotally connected to a pair of links by a second pin. A single acting cylinder of the actuating mechanism provides an unlatching force to selectively move the latch bar which is engaged with the latch notches to an unlatched position. This reference, however, does not disclose how to automatically change the impact ripper.

U.S. Pat. No. 5,813,822 for a Bucket And Thumb Combination As A Quick Decoupling Attachment issued to Pisco discloses a quick decoupling attachment for coupling a bucket and a thumb to an excavator' arm by using a pair of hydraulic actuators.

U.S. Pat. No. 5,802,747 for A Crusher issued to Nojima discloses a jaw crusher having a frame accommodating a crushing mechanism, a driving device, a bracket connected to an arm and a link rod of a power shovel. The jaw crusher is removably installed on the arm and the front end of link of the power shovel.

U.S. Pat. No. 5,592,762 for an Excavator Bucket Linkage issued to Hendron et al. discloses an excavator bucket linkage for connecting a bucket using a bucket actuating hydraulic cylinder.

U.S. Pat. No. 5,584,644 for A Coupling System issued to Droegemuller discloses coupling system for connecting a working tool to two links of a free arm by elongated pins.

U.S. Pat. No. 5,546,683 for a Bucket Attachment Device With Remote Controlled Retractable Pins issued to Clark discloses a quick coupling fixed to a main body of a boom of an excavator and connected to a bucket. A hook member formed on a front end of the main body is provided for facilitating alignment of a hinge pin adapted to receive a hook member. A pair of pivot pins of a pivot pin assembly driven by a cylinder is adapted to fit in the holes of the bucket while the hook member receives the hinge pin.

I have noticed that the embodiments described by the abovenoted references do not provide a more effective coupling mechanism because a hook member and a pin have been used for the coupling system.

U.S. Pat. No. 5,465,513 for A Device For Quick Connection Of Hydraulic Tubings issued to Sonerud discloses quick coupling assembly of an excavator. A fixed semi-circular recess of the quick coupling assembly is brought into abutment with a transverse forward bolt on the shovel attachment. A lock mechanism of the quick coupling assembly is moved towards the second transverse bolt with the aid of at least one hydraulic piston-cylinder device.

U.S. Pat. No. 5,125,788 for a Quick-Change System issued to Stenger discloses a quick-change system for a dipper shovel housed in an adapter which is connected to a coupling rod and a bending arm. In the adapter, a locking element includes pistons coaxially arranged in a cylindrical housing and locking pins arranged between legs of the dipper shovel.

I have noticed that the embodiments taught by the abovenoted references are not adequate to support the excavating device because of the vibration and impact generated by the device and propagated to the assembling mechanism during operation of the device.

U.S. Pat. No. 5,431,528 for a Quick Coupling Arrangement For Excavator Buckets And Like issued to Jenkins et al. discloses a quick coupling arrangement for excavator bucket. The link assemblies are detachably secured to an arm and power link of an excavator by first and second pin assemblies respectively connected to the arm and power link. Rollers are mounted on link assemblies and received by receptacles.

U.S. Pat. No. 5,350,250 for A Quick Coupling Of A Front Work Attachment On Excavators issued to Nagler discloses a quick coupling device having hook shaped cams formed on a first coupling plate of an excavator boom and catch recesses formed on a second coupling plate and engaging hook shaped cams while first coupling plate is contacting the second coupling plate in a coupling position.

U.S. Pat. No. 5,332,353 for A Quick Coupler For Excavation Equipment issued to Arnold discloses a quick coupler for excavation equipment including a bucket having first and second pins and an arm having slots openings coupled to the pins by using a latch assembly.

U.S. Pat. No. 4,984,850 for a Linear Impact Ripper Apparatus issued to Jensen discloses an interconnection and an arrangement of a linear ram within a tool holder and an impact hammer.

I have found that the abovenoted embodiments do not show a coupling structure adequate to couple the tool holder to the tool and automatically change from a hydraulic hammer to another device.

In my opinion, the apparatus and techniques represented by this art are neither adequate to support the excavating device and the mechanism for automatic assembler nor effective to reduce the vibration and the impact generated by the excavating device and propagated to the mechanism for the automatic assembler during operation of the excavating device.

SUMMARY OF THE INVENTION

It is an object of the present invention to provide an improved coupling apparatus for automatically attaching an excavating device or a hammer device to an excavator.

It is another object to provide a coupling apparatus for automatically detaching an excavating device or hammer device from an excavator.

It is yet another object to provide a coupling apparatus for locating a coupling device on an end opening of an arm link or operation link in order to allow an excavating device to be directly coupled to the end opening of the excavator without an intermediate plate.

It is still another object to provide a coupling apparatus able to strengthen the assembling force maintained by piston rods of the coupling device.

It is still yet another object to provide a coupling apparatus for effectively and exactly guiding and supporting reciprocal movement of the pistons.

It is further object to provide a coupling apparatus for guiding the coupling device between a pair of brackets in assembling position.

It is another further object to provide a coupling apparatus for enabling the piston rod of the coupling device to be rotatably connected to the excavating device.

It is also an object to provide a coupling apparatus for protecting a user from being injured due to the coupling process.

These and other objects may be achieved by using a coupling apparatus in an excavator for coupling an excavating device, such as bucket, crusher, a pneumatic or hydraulic jack hammer, or working tool, to the excavator. The excavating device includes a pair of brackets having a pair of assembling holes formed on each bracket. The excavator includes an arm of a boom, an operation link rotatably connected to a piston link of the boom, an auxiliary link rotatably connected to both the arm and the operation link of the boom. An arm coupler containing a cylinder is rotatably fixed to an end opening of the arm without an intermediate plate while a link coupler containing a cylinder is rotatably fixed to an end opening of the operation arm. Both the arm coupler and the link coupler are connected by a connecting plate or rod. In order to replace the used arm coupler and link coupler, the arm coupler and link coupler may be detachably fixed to the end of arm and operation link by bolts and nuts.

A pair of pistons contained in the cylinder includes a guide hole formed on one end of the piston and a piston rod formed on the other end of the piston. A supporting rod is slidably inserted into guide holes and guides and supports the reciprocal movement of the pistons. A spring is connected between both piston heads of the pistons. In a preferred embodiment, a supporting rod is extended from one piston and is slidably inserted into a guide hole formed on the other piston.

The size of the arm coupler is different from that of the link coupler. In this embodiment, the size of the arm coupler is bigger than that of the link coupler. The excavating device can be replaced by various types of excavating devices and percussion devices, such as bucket, breaker, crusher, or jack hammer for digging and for breaking and crushing rock or the pavement. In these instances, brackets including assembling holes are formed on these devices to be coupled to the excavator.

The piston rods protrudes through seal members and are inserted into a pair of assembling holes of the bracket of the excavating device using hydraulic fluid in order to couple the excavating device to the excavator. The excavating device is attached to the excavator. The piston rods are pulled from an assembling position into the cylinder through seal members for a dissembling position and are detached from the assembling holes of the brackets of the excavating device using hydraulic fluid.

During moving to the assembling position, the pistons are guided and supported by the supporting rod inserted into the guide holes of the pistons. Moreover, the pistons in the assembled position are supported to maintain the assembled position by the supporting rod in spite of the vibration generated by the excavating device and propagated to the pistons and the cylinders during the operation of the excavating device.

BRIEF DESCRIPTION OF THE DRAWINGS

A more complete application of this invention, and many of the attendant advantage thereof, will be readily apparent as the same becomes better understood by reference to the following detailed description when considered in conjunction with the accompanying drawing in which like reference symbols indicate the same or similar components, wherein.

DESCRIPTION OF THE PREFERRED EMBODIMENT

Figure 1:
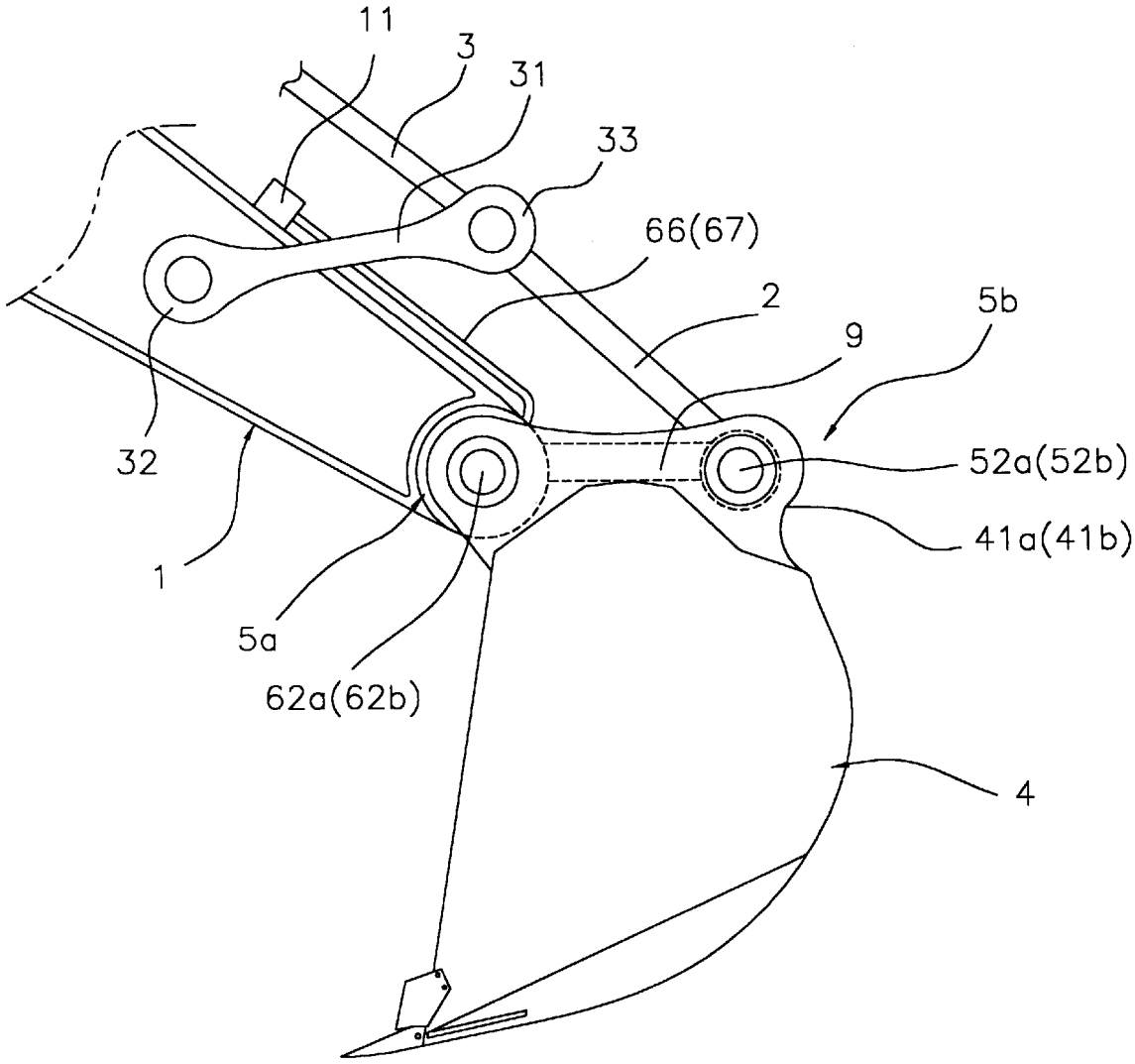
FIG. 1 is a side view of a hydraulic excavator showing a coupling device coupled between an excavating device and a main arm of the excavator according to the present invention.
Figure 2:
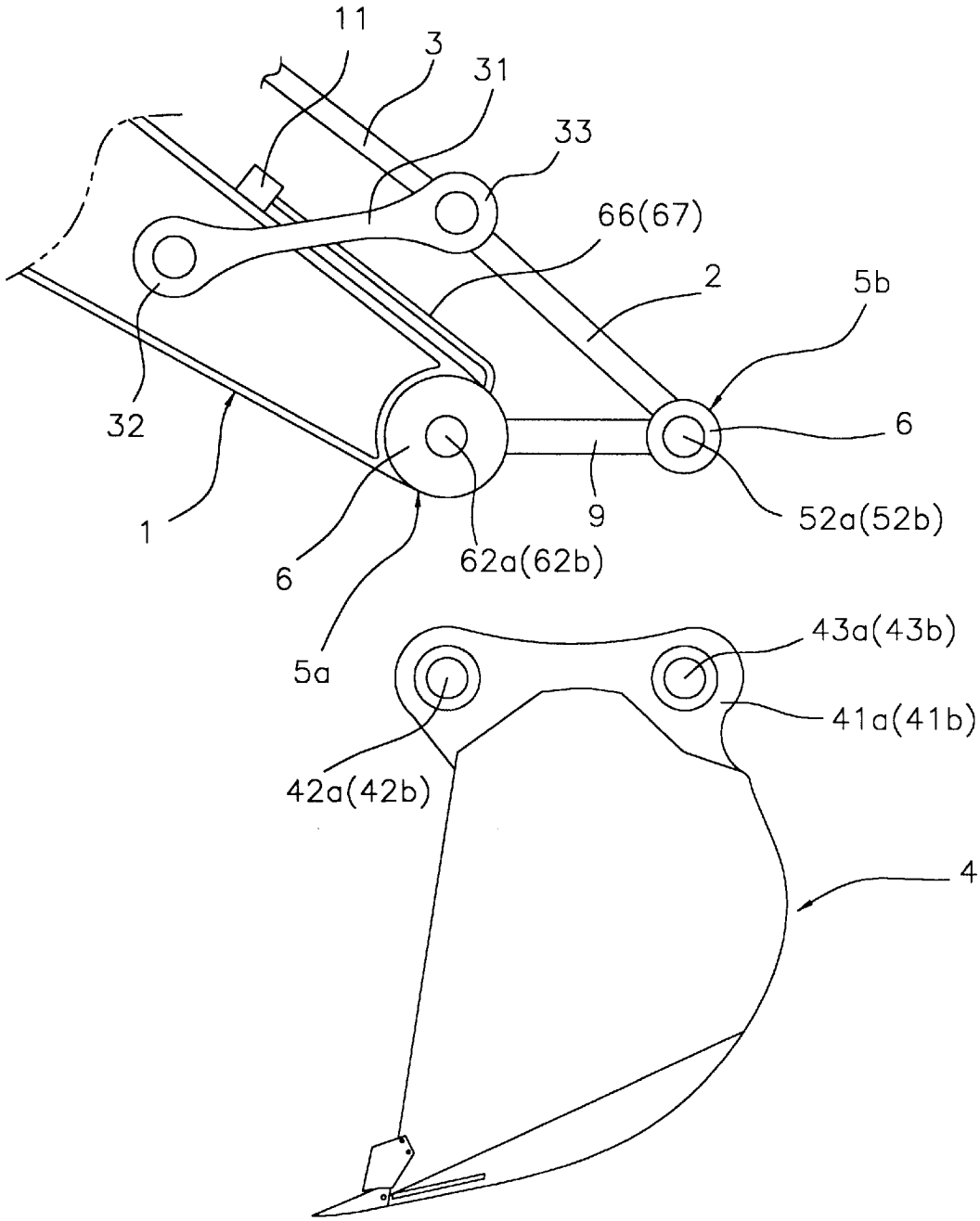
FIG. 2 is a side view showing a detached state of the excavating device and the main arm of the excavator of FIG. 1.

FIG. 1 shows an excavating device 4 attached to an arm 1 of main boom of an excavator (not shown). FIG. 2 shows a detached state of the excavating 4 device and main arm 1 of the excavator. An operation link 2 is connected between a piston link 3, and link coupler 5*b*. One end 33 of an auxiliary link 31 is rotatably connected between the piston link 3 and operation link 2 while the other end 32 of the auxiliary link 31 is rotatably fixed on the arm 1 of the main boom. The link coupler 5*b*, having a cylinder 6, is rotatably connected to one end of the operation link 2. Piston rods 52*a* and 52*b*, contained in the link coupler 5*b*, are connected to brackets 41*a* and 41*b* of the excavating device 4 through assembling holes 43*a* and 43*b* formed in brackets 41*a* and 41*b* respectively. An arm coupler 5*a*, having cylinder 6, is rotatably connected or rotatably fixed to one end of the arm 1.

The arm coupler 5*a* is rotatably connected to the end of the arm 1 while the link coupler 5*b* is fixed to the end of the operation link 2. A connecting rod 9 is connected to the link coupler 5*b*. The arm coupler 5*a* is fixed to the end of the arm 1 while the link coupler 5*b* can be rotatably connected to the end of operation link 2 in another preferred embodiments. The connecting rod 9 is connected to the arm coupler 5*a*. The arm coupler 5*a* or link coupler 5*b* may be fixed or welded to the end of the arm 1 and operation link 2 respectively. The connecting rod 9 is rotatably connected to both arm coupler 5*a* and link coupler 5*b*. In order to replace new arm coupler and link coupler, the arm coupler 5*a* and link coupler 5*b* may be rotatably fixed to the end of arm 1 and operation link 2 by bolts and nuts. The size of the arm coupler 5*a* is different from that of link coupler 5*b*. In this embodiment, the size of the arm coupler 5*a* is bigger than that of link coupler 5*b*. The excavating device 4 can be replaced by various types of excavating devices or percussion devices, such as a bucket, breaker, crusher, jack hammer for digging and for breaking and crushing rocks or pavement. In these instances, brackets including assembling holes are formed on these devices.

Figure 3:
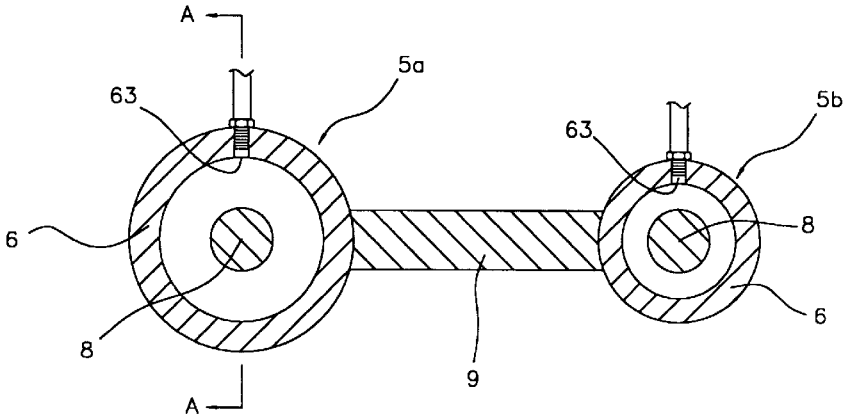
FIG. 3 is a cross-sectional view of the coupling device.
Figure 4:
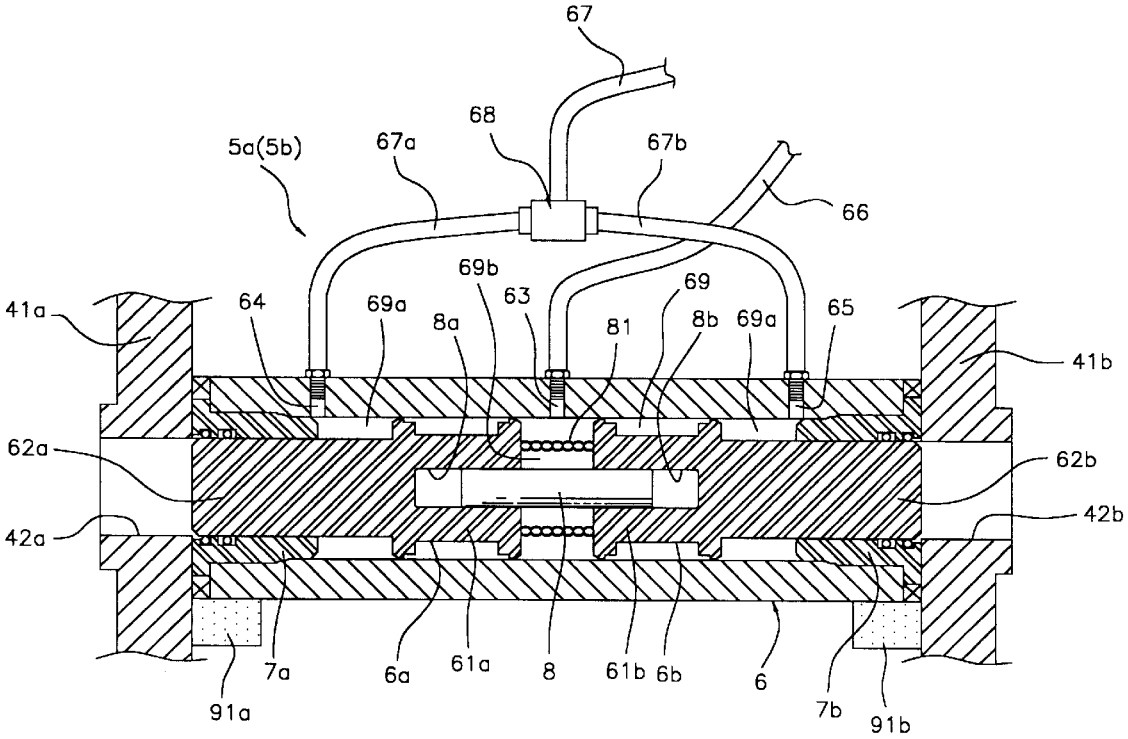
FIG. 4 is a cross-sectional view taken along line A—A of FIG. 3 .

Referring to FIGS. 3 and 4, the structure and operations of the arm coupler 5*b* are identical to link coupler 5*b*. Piston rods 62*a* and 62*b*, contained in arm coupler 5*a*, are connected to brackets 41*a* and 41*b* of an excavating device through assembling holes 42*a* and 42*b*. Hydraulic hoses 66 and 67 are connected to a hydraulic source (not shown), through an anti hydraulic backward valve 11 and are connected to the cylinder 6 of the arm coupler 5*a*.

A reciprocal movement is transmitted to the arm 1 and operation link 2 through piston link 3 and causes the excavating device 4 to rotate about an axis which runs through the center of the piston rods 62*a* and 62*b* of the arm coupler 5*a*. Therefore, the excavating device 4 can rotate during reciprocal movement. The connecting plate or rod 9 is connected to both the arm coupler 5*a* and link coupler 5*b*. One end of the connecting plate is rotatably connected to one of the arm coupler 5*a* or link coupler 5*b* while the other end is fixed to the other of the arm coupler 5*a* or link coupler 5*b*. A cross-sectional view of the arm coupler 5*a*, link coupler 5*b* and connecting plate 9 coupling to both the arm coupler 5*a* and link coupler 5*b* is shown in FIG. 3. Although FIG. 3 shows a simple type of connecting plate connected between the arm coupler 5*a* and link coupler 5*b*, the connecting plate 9 can be rotatably connected to each end of the arm 1 and operation link 2 or the arm coupler 5*a* or link coupler 5*b* through at least one ring (not shown) which encompasses the circumferential surface of each end of the arm 1 and operation link 2 or the arm coupler 5*a* and link coupler 5*b*. The ring is rotatably connected to the arm coupler 5*a* or link coupler 5*b*.

Referring FIG. 4, a cross-sectional view along line A—A of arm coupler 5*a* of FIG. 3 is shown. The cross-sectional view of the link coupler 5*b* is identical to that of arm link 5*a* except for the size thereof. Three hydraulic holes 63, 64, 65 are formed on the cylinder 6 of the arm coupler 5*a*. A main hydraulic hose 66 is connected to the middle hydraulic hole 63. A hydraulic hose 67 is connected to a three way valve 68 which is connected to two dividing hoses 67*a* and 67*b*. The dividing hose 67*a* is coupled to the hydraulic hole 64 while the dividing hose 67*b* is connected to the hydraulic hole 65. Hydraulic chambers 69*a* contained in the cylinder 6 are coupled to the two dividing hoses 67*a* and 67*b* through hydraulic holes 64, 65, and a hydraulic chamber 69*b* is coupled to the hydraulic hose 66 through the hydraulic hole 63.

Piston 6*a*, contained in the cylinder 6, has piston head 61*a* and piston rod 62*a*. A guide hole 8*a* is formed inside of piston head 61*a* and has an opening to accommodate one end of the supporting rod 8. Each of seal members 7*a* and 7*b* is attached and fixed to an end of the cylinder 6 and has a plurality of inner seals which engage piston rods 62*a* or 62*b*. The supporting rod 8 is slidably inserted into guide holes 8*a* and 8*b* and is disposed between pistons 6*a* and 6*b*. A spring 81 is connected to both piston heads 61*a* and 61*b* of pistons 6*a* and 6*b*.

Figure 5:
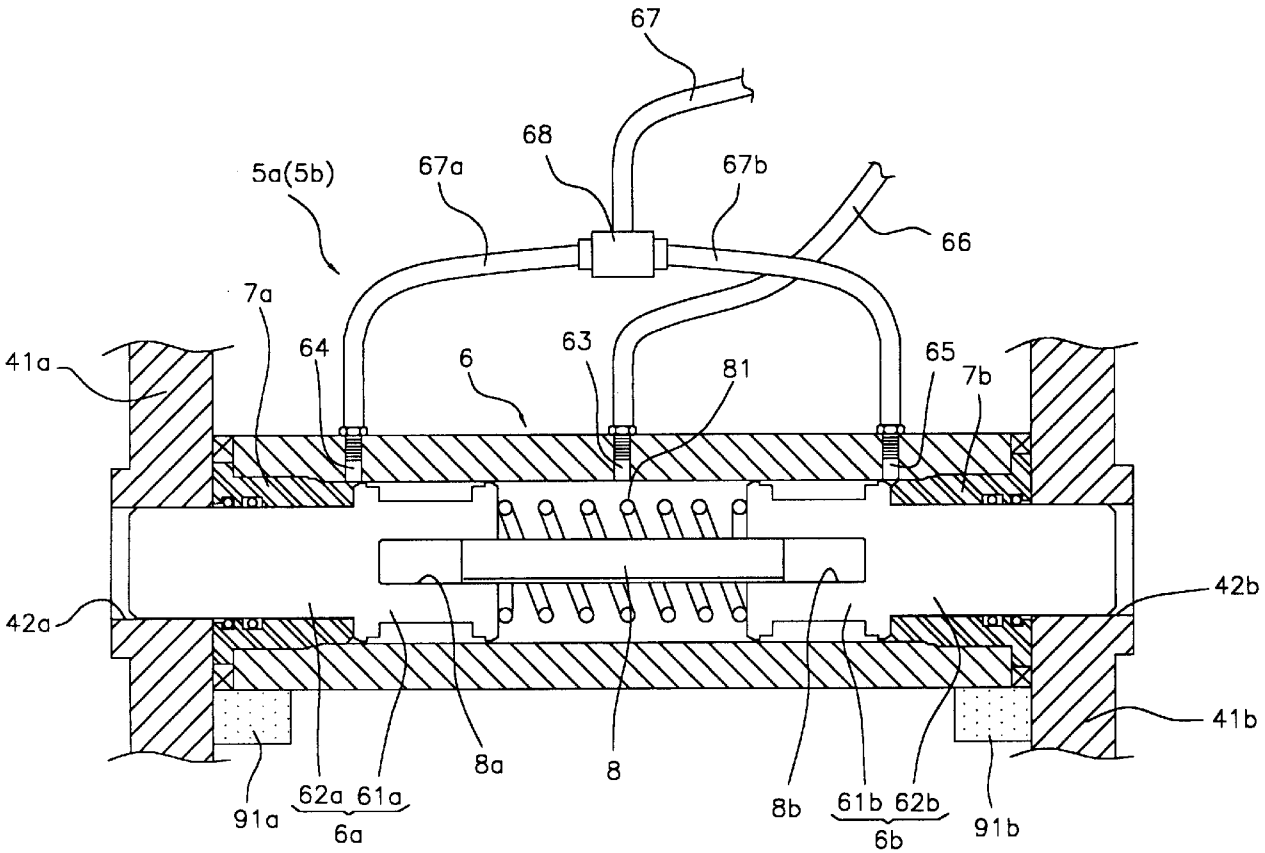
FIG. 5 is a cross-section view showing a coupling state of FIG. 4.

When hydraulic fluid is supplied to fluid chamber 69*b* through the hydraulic hose 66, and hydraulic fluid is withdrawn from fluid chamber 69*a* through dividing hoses 67*a* and 67*b*, pistons 6*a* and 6*b* are pushed outside of cylinder 6 , and piston rods 62*a* and 62*b* protrude outside of the cylinder 6 of arm coupler 5*a* through inner cylindrical holes of seal members 7*a* and 7*b* in an assembling position shown FIG. 4. When the hydraulic fluid is supplied to fluid chamber 69*a* through the dividing hoses 67*a* and 67*b* and the hydraulic fluid is withdrawn from fluid chamber 69*b* through hydraulic hose 66, pistons 6*a* and 6*b* are pulled into inside of cylinder 6, and piston rods 62*a* and 62*b* are pulled into the cylinder 6 of arm coupler 5*a* through seal members 7*a* and 7*b*. Meanwhile, the supporting rod 8 is slidably inserted into both guide holes 8*a* and 8*b* of piston 6*a* and 6*b* and supports the reciprocal movement of both piston 7*a* and 7*b* both in an assembling position and in dissembling position as shown in FIG. 5.

The arm coupler 5*a* in a dissembling position is located between brackets 41*a* and 4*b* of the excavating device 4. Assembling holes 42*a* and 42*b* and piston rod 62*a* and 62*b* of the arm coupler 5*a* can be leveled by guide members 91*a* and 91*b*. Various kinds of the sensors such as a switch (not shown) may be used for confirming of the leveling of the excavating device and arm coupler, and for guiding the arm coupler 5*a* into the bracket. The sensors may be located on various positions of the bracket or arm coupler 5*a* or link coupler 5*b* in order to detect the contact between arm coupler and the bracket or centering the hole and piston rod. If the arm coupler 5*a* contacts a sensor which is installed on the guide member 91*a* and 91*b*, the sensor transmits a signal to a user. On the basis of the confirmation of the leveling of the excavating device 4 and arm coupler 5*a*, cylinder 6 operates in an assembling position. Piston rods 62*a* and 62*b* protrude and are inserted into the assembling holes 42*a* and 42*b* of brackets 41*a* and 41*b*. Piston rods 52*a* and 52*b* of the link coupler 5*b* can be coupled to assembling holes 43*a* and 43*b* of brackets 41*a* and 41*b* while piston rods 62*a* and 62*b* of the arm coupler 5*a* are coupled to assembling holes 42*a* and 42*b* of brackets 41*a* and 41*b*. Another sets of guide members can be installed on the link coupler 5*b* or near assembling holes 43*a* and 43*b* of brackets 41*a* and 41*b*. The excavating device 4 is attached to the excavator through the arm coupler 5*a* as shown in FIG. 5.

In order to disassemble the excavating device 4 from the arm coupler 5*a,* cylinder 6 operates in its dissembling position. Pistons 6*a* and 6*b* are pulled inside of the cylinder 6, and piston rods 62*a* and 62*b* are pulled into the cylinder 6 of the arm coupler 5*a* through seal members 7*a* and 7*b* as shown in FIG. 4. After the cylinder 6 operates in its disassembling position, the arm coupler 5*a* of arm 1 can be detached from brackets 41*a* and 41*b* of the excavating device 4. The arm 1 having arm coupler 5*a* and link coupler 5*b* then moves to another location where the other excavating device is located so as to be assembled.

Figure 6:
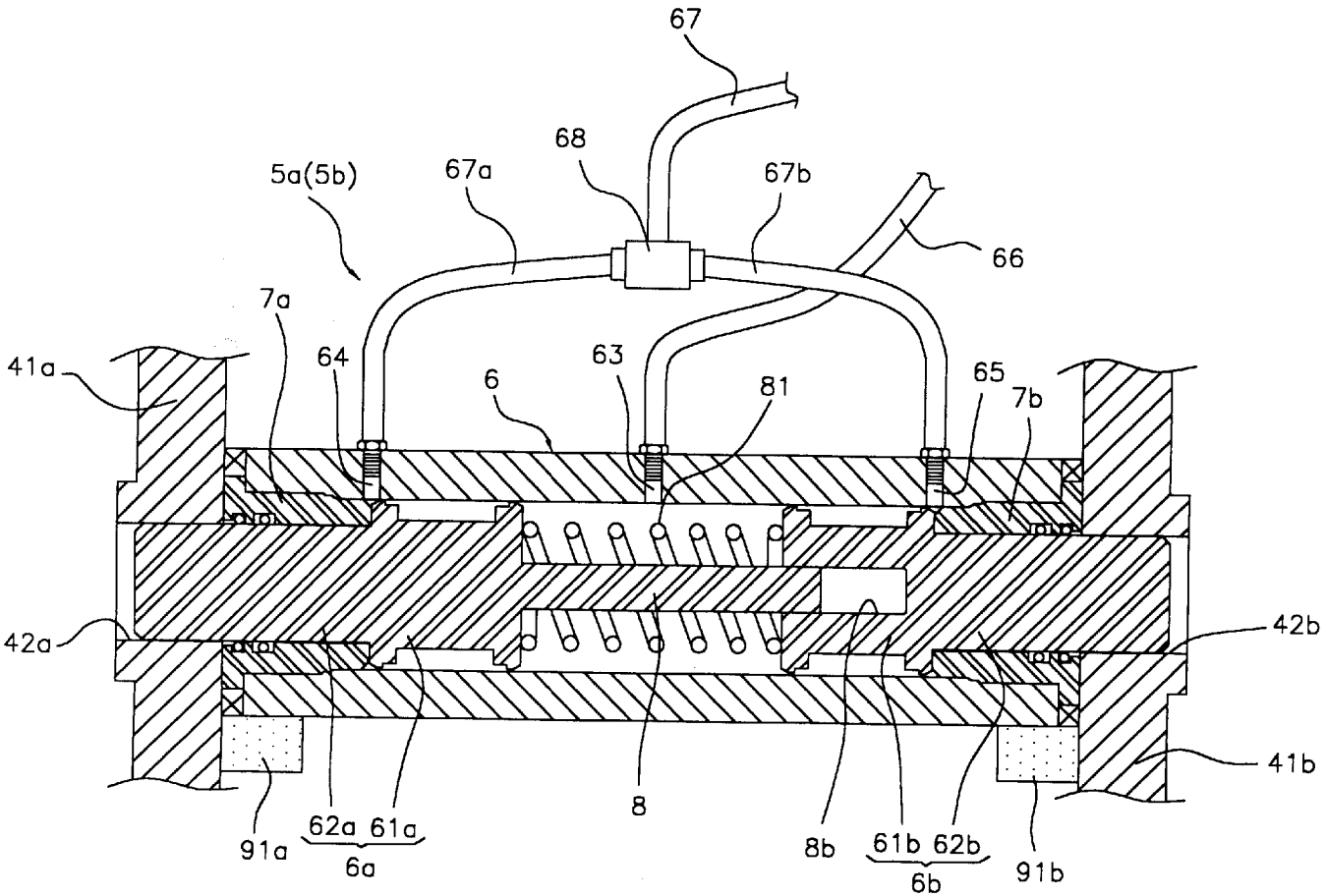
FIG. 6 is a cross-sectional view showing another embodiment of the coupling device.

FIG. 6 shows another preferred embodiment of the invention. Instead of slidably inserting supporting rod into both guide holes 8*a* and 8*b* formed on piston heads 61*a* and 61*b* of pistons 8*a* and 8*b* as shown in FIGS. 4 and 5, supporting rod 8 is extended from piston head 61*a* of piston 6*a* and is slidably inserted into guide hole 8*b* formed on piston head 61*b* of piston 6*b*. A spring 81 can be located around of the supporting rod 85 and is connected both end sides of piston head 61*a* and 61*b* of piston 6*a* and 6*b*.

Figure 7:
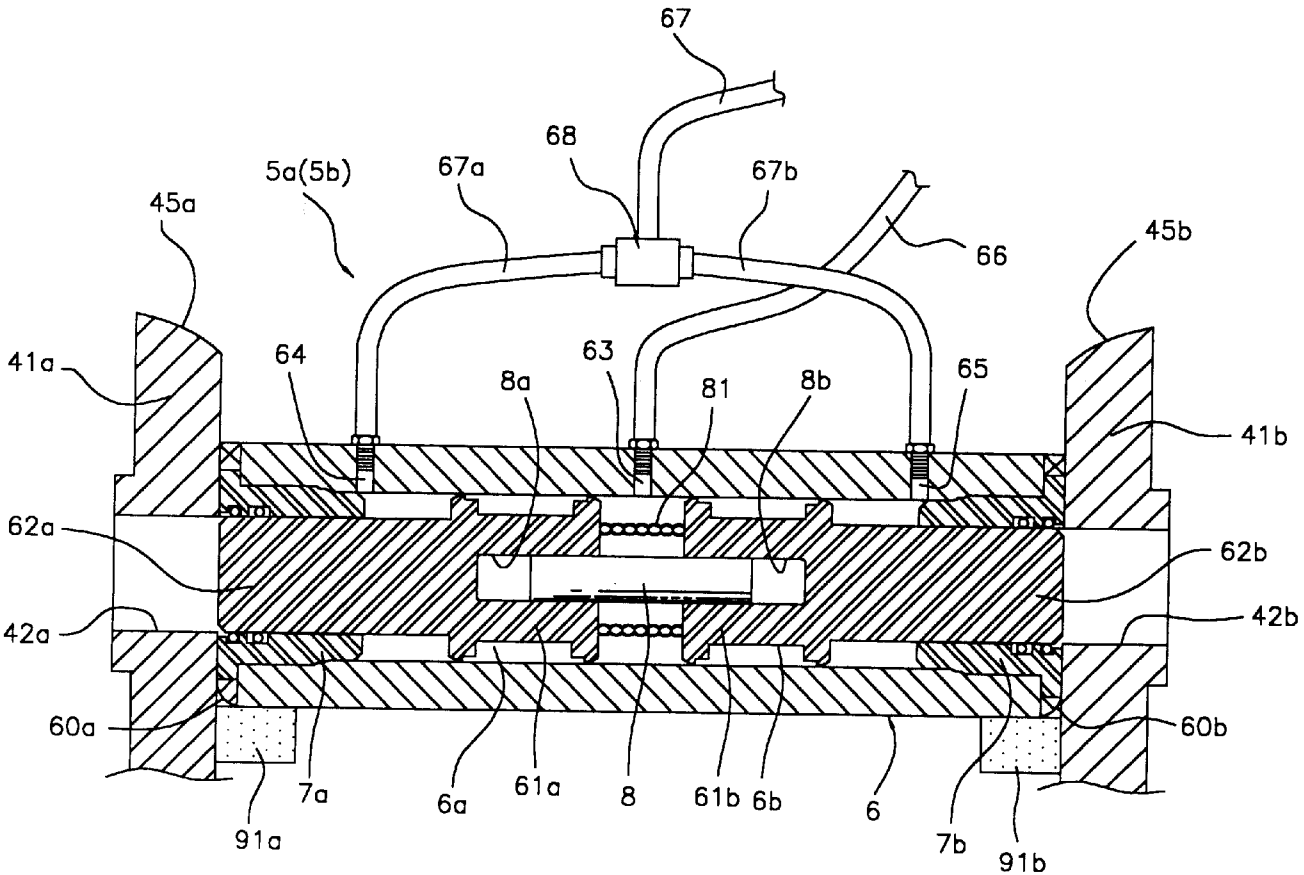
FIG. 7 is a cross-sectional view showing another preferred embodiment of the coupling device according to the present invention.

Referring to FIG. 7, a pair of rounded end portions 45*a* and 45*b* are formed on the pair of brackets 41*a* and 41*b* in order to guide the cylinder 6 of the arm coupler 5*a* or link coupler 5*b* between brackets 5*a* and 5*b* during the locating of the arm coupler 5*a* and link coupler 5*b* between brackets 41*a* and 41*b*. A pair of rounded cylindrical end portions 60*a* and 60*b* may be formed on bottom corner portion of cylinder 6.

Figure 8:
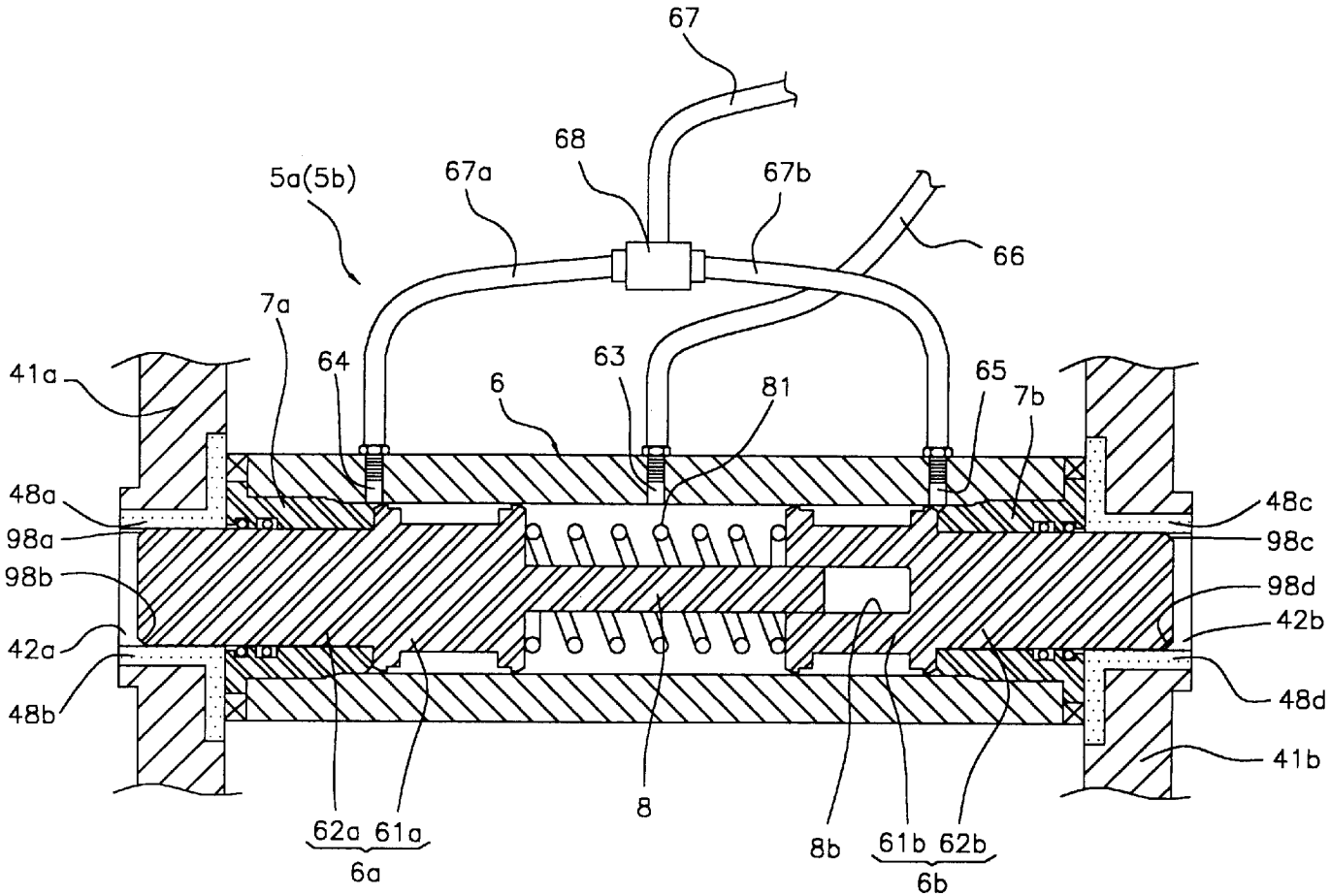
FIG. 8 is a cross-sectional view showing an absorber attached to the coupling device according to the present invention.

If a percussion device is attached to arm 1, vibration or impact generated from the percussion device may be transmitted to the cylinder 6 of arm coupler 5*a* or link coupler 5*b*. In order to prevent the vibration and the impact from being propagated to cylinder 6 of arm coupler 5*a* or link coupler 5*b* through brackets 41*a* and 41*b*, vibration or impact absorbing material 48*a*, 48*b*, 48*c*, and 48*d*, such as polyurethane or nitrile-butadiene rubber (NBR), may be inserted between brackets 41*a* and 41*b* and cylinder 6 as shown FIG. 8. The excavating device rotates about an axis passing through the center line of the piston rods 62*a* and 62*b* due to the operation of the operation link 2. Therefore, this vibration or impact absorbing material absorbs not only the vibration but also rotational impact of the piston rods 62*a* and 62*b* rotating inside of holes 42*a* and 42*b* because the excavating device rotates about an common axis of the arm coupler 5*a* and hole 42*a* coupled to arm coupler. Rounded corners 98*a*, 98*b*, 98*c*, and 98*d* are formed on the circumferential corners of piston rods 62*a* and 62*b* so as to guide piston rods 62*a* and 62*b* to be inserted into assembling holes 42*a* and 42*b* in the assembling position.

According to the principles of this invention, an excavating device can be detachably attached to the excavator automatically and can be replaced easily by using at least one cylinder or the other connecting mechanism automatically controlled by a user who is located at a location remote from the excavating device.

While this invention has been described in connection with what is presently considered to be the most practical and the disclosed embodiments, but it is to be understood that the invention is not limited to the disclosed embodiments, but, on the contrary, is intended to cover various modifications and equivalent arrangements included within the sprit and the scope of the amended claims.

What is claimed is:

1. A coupling apparatus in an excavator, comprising:

an arm coupler fixed to one end of an arm of said excavator, said arm coupler having a first cylinder containing a pair of first pistons and first side openings;

a link coupler fixed to one end of an operational link of said excavator, said link coupler having a second cylinder containing a pair of second pistons and second side openings;

a connecting member directly connected to and fixed between said arm coupler and said link coupler, maintaining a first fixed distance between longitudinal center lines of said arm coupler and said link coupler;

an excavating device having two pairs of first and second holes respectively formed on a pair of brackets, said first holes having a first common center line spaced apart from a second common center line passing through centers of said second holes by a second fixed distance same as said first fixed distance;

a pair of first piston rods each formed on an outer end of said first pistons contained in said arm coupler, protruding outwardly through one of said first side openings, rotatably inserted into said first holes for connecting said excavating device to said excavator; and a pair of second piston rods each formed on an outer of said second pistons contained in said link coupler, protruding outwardly through one of said second side openings, rotatably inserted into said second holes for connecting said excavating device to said excavator.

2. The apparatus of claim 1, further comprised of:

guide holes each formed on an inner end of said first pistons;

a supporting rod disposed between said first pistons and inserted into said guide holes of said first pistons, supporting said first pistons while said excavating device is connected to said excavator; and a resilient member disposed between said first pistons and inserted around said supporting rod.

3. The apparatus of claim 1, further comprised of:

a guide hole formed an inner end of one of said first pistons and opposite to said first piston rod of said one of said first pistons;

a supporting rod formed on and extended from an inner end of the other one of said first pistons and opposite to said outer end of said the other one of said first pistons and inserted into said guide hole for supporting said pistons while said excavating device is connected to said excavator; and a resilient member disposed between said first pistons and inserted around said supporting rod.

4. The apparatus of claim 1, said first piston rods of said arm coupler being greater than said second piston rods of said link coupler in diameter.

5. The apparatus of claim 1, further comprised of a pair of first fluid chambers each disposed between each of said first pistons and said cylinder of said arm coupler.

6. The apparatus of claim 5, further comprised of a hydraulic hose connected to each of said first fluid chambers through a three way valve and a dividing hose coupled between said three wave valve and a hydraulic hole formed on each of first fluid chamber.

7. The apparatus of claim 6, further comprised of a second fluid chamber disposed between said first pistons and connected to a second hydraulic hose.

8. The apparatus of claim 1, further comprised of an absorber disposed between said first cylinder and one of said brackets.

9. The apparatus of claim 1, further comprised of an absorber formed on a peripheral inner surface of said holes of said brackets and disposed between one of said first piston rods and said one of said first holes.

10. The apparatus of claim 1, further comprised of at least one guide member fixed on one of either one of said brackets and said arm coupler, guiding said arm coupler when said first piston rods are aligned with said first holes.

11. The apparatus of claim 1, further comprised of at least one sensor located on one of either one of said brackets said arm coupler.

12. A coupling apparatus in an excavator, comprising:

a pair of couplers fixed to an arm link and an operation link of said excavator, each having a cylinder;

a connector directly connected to and fixed between said couplers, having a first fixed distance between longitudinal center lines of said couplers;

a pair of pistons contained in said cylinder of each of said couplers, each having a piston rod being formed on an outer end of each piston and a piston head formed on an inner end of said each piston and opposite to said piston rod;

guide holes formed on each piston head of said pair of pistons;

a supporting rod, disposed between said pistons and inserted into said guide holes of said pistons for supporting said pistons; and a resilient member disposed between said piston heads of said pistons and inserted around said supporting rod.

13. The apparatus of claim 12, wherein said pistons of the coupler coupled to said arm link are greater than the pistons of the coupler coupled to said operation link in diameter.

14. The apparatus of claim 12, further comprised of:

a plurality of first fluid chambers each disposed between one of said pistons and its respective cylinder and connected to a first hydraulic hose; and a second fluid chamber disposed between said pistons of each coupler and connected to a second hydraulic hose.

15. The apparatus of claim 14, each said first hydraulic hose being connected to each of said first fluid chambers of its coupler through a three way valve coupled to said first hydraulic hose and two dividing hoses coupled between said three way valve and said each of said first fluid chambers of its coupler.

16. The apparatus of claim 12, further comprised of an external device coupled to said excavator, said external device having two pairs of first and second holes formed on a pair of brackets of said external device, each piston rod being rotatably inserted into one of said first and second holes.

17. The apparatus of claim 16, further comprised of an absorber disposed between said cylinder and one of said brackets.

18. The apparatus of claim 16, further comprised of an absorber fixed on a peripheral inner surface of one of said first and second holes and disposed between said piston rod and said one of said first and second holes when said piston rod protrudes from said cylinder and is inserted into said one of said first and second holes.

19. The apparatus of claim 16, further comprised of at least one guide member fixed of either one of said brackets or one of said couplers.

20. The apparatus of claim 16, further comprised of at least one sensor located on one of either one of said brackets or one of said couplers.

21. A coupling apparatus in an excavator, comprising:

a pair of couplers fixed to an arm and an operation link of said excavator, each having a cylinder;

a connector directly connected to and fixed between said couplers, maintaining a predetermined fixed distance between longitudinal center lines of said couplers;

first and second pistons contained in each of said couplers, each piston having a piston rod formed on an outer end of said piston and a piston head formed on an inner end of said piston and opposite to said piston rod;

a guide hole formed on said piston head of said first piston;

a supporting rod formed on said piston head of said second piston, disposed between said first and second pistons and inserted into said guide hole of said first piston for supporting said first and second pistons; and a resilient member disposed between said first and second pistons and inserted around said supporting rod.

22. The apparatus of claim 21, wherein said pistons of the coupler coupled to said arm link are greater than the pistons of the coupler coupled to said operation link in diameter.

23. The apparatus of claim 21, further comprised of:

a plurality of first fluid chambers each disposed between each of said plurality of pistons and its respective said cylinder;

a hydraulic hose connected to each of said first fluid chambers through a three way valve coupled to said hydraulic hose end a dividing hose coupled between said three way valve and one of said first fluid chambers; and a second fluid chamber disposed between said pistons of each cylinder and connected to a hydraulic hose.

24. The apparatus of claim 21, further comprised of an external device coupled to said excavator, having a plurality of holes formed on a plurality of brackets of said external device, said piston rod being rotatably inserted into one of said plurality of holes.

25. The apparatus of claim 24, further comprised of an absorber fixed on a peripheral inner surface of said holes and disposed between said cylinder and one of said brackets.

26. The apparatus of claim 24, further comprised of at least one guide member fixed on one of said brackets, guiding said couplers when each piston rod of said first and second pistons is aligned with one of said holes.

27. The apparatus of claim 24, further comprised of at least one sensor located on one of either one of said brackets or one of said couplers.

28. The apparatus of claim 1, further comprised of two guide members fixed to both inside surfaces of said brackets, contacting said couplers when said first piston rods are aligned with said first holes of said brackets.

29. The apparatus of claim 1, further comprised of an end portion formed on a distal end of said brackets, having a round shape, guiding said couplers inserted between said brackets.

30. The apparatus of claim 16, further comprised of a round distal end formed on each end of said brackets, guiding said couplers inserted between said brackets.

31. The apparatus of claim 24, further comprised of a round distal and formed on each end portion of said brackets, guiding said couplers inserted between said brackets.

* * * * *